US005781116A

United States Patent [19]

Hedger et al.

[11] Patent Number: 5,781,116

[45] Date of Patent: Jul. 14, 1998

[54] CATALYST FLOW ALARM

[75] Inventors: Thomas A. Hedger; Scott McGehee, both of Largo, Fla.

[73] Assignee: Graves Spray Supply, Inc., Clearwater, Fla.

[21] Appl. No.: 775,646

[22] Filed: Dec. 31, 1996

[51] Int. Cl.[6] ..... G08B 21/00

[52] U.S. Cl. ..... 340/606; 340/611; 340/614; 340/618; 340/626; 137/554; 137/557

[58] Field of Search ..... 340/606, 611, 340/614, 618, 626; 137/554, 557, 565; 116/267; 73/198

[56] References Cited

U.S. PATENT DOCUMENTS 3,429,291 2/1969 Hoffman .
3,445,174 5/1969 Matthews .
4,087,230 5/1978 Matthews .
4,130,745 12/1978 Hetzer ..... 431/46
4,465,095 8/1984 Lindberg ..... 137/556
4,603,707 8/1986 Gregoire et al. ..... 137/557
4,747,364 5/1988 Horowitz ..... 116/268
4,792,113 12/1988 Eidsmore ..... 137/522

*Primary Examiner*—Brent A. Swarthout
*Assistant Examiner*—Daniel J. Wu
*Attorney, Agent, or Firm*—Larson & Larson, P.A.; James E. Larson

[57] ABSTRACT

A flow alarm includes a magnetic switch that is maintained open so long as catalyst flow is maintained and an air flow switch that is closed responsive to flow of air through an associated conduit. The associated conduit supplies air via a solenoid valve to a pneumatic whistle. When flow of catalyst falls below a pre-set threshhold, the magnetic switch closes completing the circuit with the solenoid valve causing the solenoid valve to open and allowing air flow to the pneumatic whistle to signal the reduction of catalyst flow.

15 Claims, 1 Drawing Sheet

CATALYST FLOW ALARM

BACKGROUND OF THE INVENTION

The present invention relates to a catalyst flow alarm. In the prior art, alarm systems are known that include the use of magnetic switches to activate an alarm. However, Applicant is unaware of any such device or system that includes the use of a normally open magnetic switch which is closed through movement of a magnet that is biased away from the switch solely through the force of gravity within a magnet chamber of specified dimensions, with the device or system having the further provision of an air flow switch that is closed responsive to flow of air therethrough so that both the magnetic switch and the air flow switch must be closed to cause activation of an alarm whistle.

In a further aspect, the present invention is particularly intended to be used in the environment of plural component spray equipment, particularly such equipment designed to spray polyester resins and gelcoats with low catalyst delivery rates. In such systems, it is important for the user to become immediately aware when the catalyst flow rate reduces below a pre-set threshhold. The present invention is intended to solve this problem by monitoring the catalyst flow rate and causing emission of a loud audible signal when the catalyst flow rate reduces below the pre-set threshhold.

In another aspect, in the environment of intended use, the particular catalyst employed, Methyl Ethyl Ketone Peroxide, is highly corrosive. The most advantageous design of the present invention contemplates a magnetic switch activating magnet being continuously immersed within the catalyst within a chamber through which the catalyst flows, the flow of catalyst causing the magnet to move upwardly within the chamber to open the magnetic switch. This is the most advantageous design. However, ordinary magnets exposed to such a corrosive material would soon deteriorate and react, potentially causing an explosion. Thus, Applicant had to develop or choose a magnet strong enough to convey a magnetic field through a corrosion-resistant housing for the magnetic switch while at the same time being immune to the corrosive effects of the catalyst. An essential part of the present invention comprises a solution to this problem.

The following prior art is known to Applicant:

U.S. Pat. No. 3,429,291 to Hoffman

U.S. Pat. No. 3,445,174 to Matthews

U.S. Pat. No. 4,087,230 to Matthews

U.S. Pat. No. 4,130,745 to Hetzer

U.S. Pat. No. 4,603,707 to Gregoire et al.

U.S. Pat. No. 4,747,364 to Horowitz.

The present invention differs from the teachings of these references since none of them taken alone or in combination with other ones of the references teaches or suggests the concept of a gravity biased magnet exposed to a corrosive catalyst and having a sufficiently strong enough magnetic field to penetrate a corrosive-resistant housing for the associated magnetic switch. Furthermore, none of the prior art taken alone or in combination teaches or suggests the concept of combining a magnetic switch with an air flow switch in such a manner that both switches must be closed to permit activation of an audible signal, with the air flow switch being incorporated in the flow line conveying air to a pneumatic whistle.

SUMMARY OF THE INVENTION

The present invention relates to a catalyst flow alarm. The present invention includes the following interrelated objects, aspects and features:

(1) In a first aspect, the present invention is intended to be used in the environment of plural component spray equipment, particularly such equipment that sprays polyester resins and gelcoats with extremely low catalyst delivery rates. In some cases, the delivery rates can be as low as 5 cubic centimeters per minute or as high as 150 cubic centimeters per minute. In particular, the polyester material is mixed with the catalyst beyond the delivery nozzle so that the polyester material will cure, for example, on a boat hull.

(2) The present invention contemplates a pneumatic whistle activated when flow of catalyst drops below a pre-set threshhold. Pressurized air provided to operate the pneumatic whistle flows through a conduit through an air flow switch and then to a solenoid actuated valve that, when open, allows flow of air through the pneumatic whistle to activate it. When pressurized air flows through the air flow switch, the switch is closed completing a portion of an electrical circuit.

(3) When catalyst flows through a catalyst conduit, it enters a catalyst flow tube having, contained therein, a permanent magnet that is biased downwardly toward the catalyst flow tube inlet through the force of gravity. The magnet has a surface facing the catalyst flow tube inlet that is impinged upon by catalyst flowing through the catalyst flow tube so that when catalyst is flowing at a flow rate above a pre-set threshhold, the magnet is caused to move, against the force of gravity, upwardly within the catalyst flow tube and to rest adjacent a wall of a magnetic switch that is normally closed but remains open when the magnet is adjacent thereto.

(4) When flow of catalyst within the flow tube drops below the pre-set threshhold, the magnet drops away from the magnetic switch causing the magnetic switch to close. At the same time, flow of pressurized air through the air flow switch causes the air flow switch to be closed as well. When both the air flow switch and the magnetic switch are closed, a circuit is completed causing activation of the solenoid of the solenoid valve, causing the solenoid valve to open and allow pressurized air to flow through the pneumatic whistle causing it to activate to thus notify the user of the reduction of flow of catalyst. With such notification, the spraying system may be shut down and the cause for reduction of catalyst flow can be easily determined.

(5) In the preferred embodiment of the present invention, the particular catalyst employed is Methyl Ethyl Ketone Peroxide, an extremely corrosive catalyst. As such, in the preferred embodiment, the housing for the magnetic switch is made of stainless steel having a wall thickness of from 0.030–0.150 inches with about 0.050 inches preferred. Furthermore, the particular magnet of choice is a rare earth magnet material enclosed in a plastic housing that generates a powerful enough field to cause activation of the magnetic switch across the wall thickness of the stainless steel housing thereof. Preferred is an ALNICO 5 magnet enclosed in a polyethylene housing. ALNICO 5 magnets are carbon free, electronically conductive aluminum/nickel/cobalt alloys.

Accordingly, it is a first object of the present invention to provide a catalyst flow alarm.

It is a further object of the present invention to provide such a device wherein a pneumatic whistle is activated when a magnetic switch is closed responsive to reduction in flow rate of a catalyst within a catalyst flow tube.

It is a yet further object of the present invention to provide such a device wherein air supply to a pneumatic whistle closes an air flow switch in a circuit with a magnetic switch.

These and other objects, aspects and features of the present invention will be better understood from the following detailed description of the preferred embodiment when read in conjunction with the appended drawing FIGURE.

BRIEF DESCRIPTION OF THE DRAWINGS

The sole FIGURE shows a schematic representation of the inventive system.

SPECIFIC DESCRIPTION OF THE PREFERRED EMBODIMENT

Figure 1:
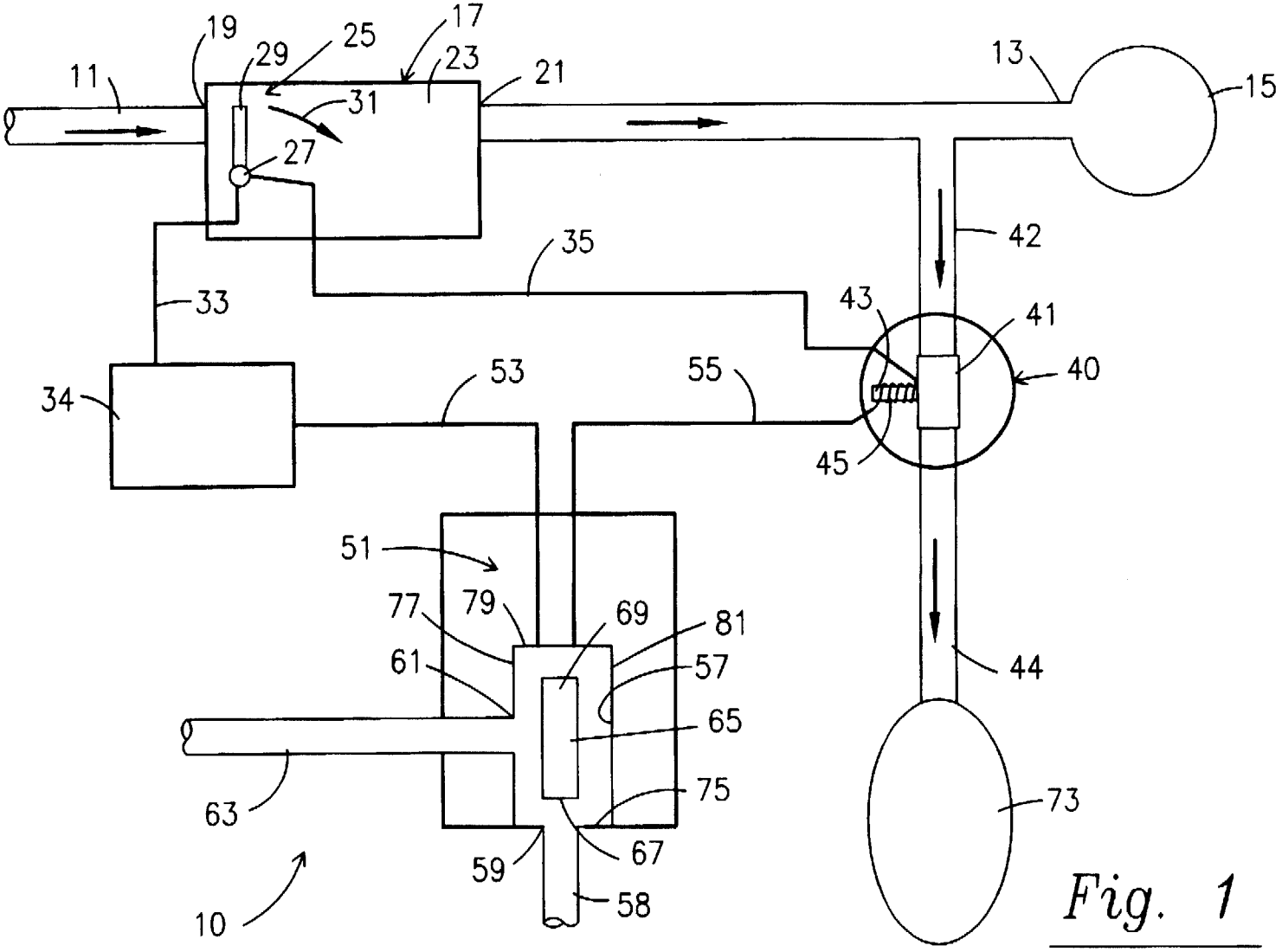

With reference to the sole FIGURE, the inventive system is generally designated by the reference numeral 10. The system includes a conduit 11 supplying air to the intake side 13 of a pump 15. The conduit 11 has, incorporated therein, an air flow switch 17 having an inlet 19, an outlet 21 and an internal chamber 23 through which air flows. Within the chamber 23, a switch mechanism 25 comprises a pivot 27 and a plate 29 upon which air impinges to cause the plate 29 to pivot in the direction of the arrow 31 to a position closing the switch. A spring (not shown) biases the plate 29 to the position shown in the FIGURE. Electrical conductors 33 and 35 are interconnected into the switch 17 as shown. One end of the conductor 33 is connected to the switch 17 and the other end thereof is connected to a battery 34 such as, for example, a 9 volt battery. One end of the conductor 35 is connected to the switch 17 and the other end thereof is connected to one terminal of a coil 45 of a solenoid actuated valve 40 that includes a valve gate 41 connected to a magnetically attractive rod 43 that extends through the coil 45 comprising the solenoid. The rod 43 may be suitably biased to a position of closure of the valve gate 41.

The present invention also includes a housing 50 containing a magnetic switch 51 having one electrical conductor 53 interconnected between the switch 51 and the battery 34 and having another electrical conductor 55 connecting between the magnetic switch 51 and the coil 45 of the solenoid valve 40. The magnetic switch 51 is of the type that is normally closed but may be maintained open through proximity of a strong enough magnetic field.

The housing 50 also includes a chamber 57 termed a catalyst flow tube that has an inlet 59 in wall 75 receiving flow of catalyst from a conduit 58 and an outlet 61 in wall 77 allowing catalyst to flow out of the catalyst flow tube 57 and into the conduit 63. The inlet 59 is located directly at the bottom of the catalyst flow tube 57 and the conduit 58 is directly in alignment with the axis of elongation of the catalyst flow tube 57 as seen in the FIGURE.

Disposed within the catalyst flow tube 57 in a chamber formed by walls 75, 77, 79 and 81 is a permanent magnet 65 of elongated configuration and having a bottom face 67 facing the inlet 59 and a top face 69 facing the magnetic switch 51. With the arrangement as shown in the FIGURE, gravity causes the magnet 65 to tend to sit with the surface 67 over the inlet 59 when no catalyst flow is taking place. As catalyst flows within the conduit 58 and enters the inlet 59, as should be understood by those skilled in the art, the increasing flow rate of the catalyst causes a differential pressure across the surfaces 67 and 69 of the magnet 65. When the differential pressure overcomes the gravity force, the magnet 65 begins to elevate within the tube 57. When the magnet 65 elevates to a position wherein the surface 69 thereof is in close proximity to the magnetic switch 51, the magnetic switch 51 is opened thus opening the circuit including the battery 34, air flow switch 17, solenoid valve 40. So long as catalyst flows through the conduit 58, inlet 59, catalyst flow tube 57, outlet 61 and conduit 63 at a sufficient flow rate to maintain the surface 69 of the magnet 65 in close enough proximity to the magnetic switch 51 that the magnetic switch 51 is maintained open, the circuit is maintained open, the valve 40 is maintained closed, and the pneumatic whistle does not operate.

If, for any reason, the rate of flow of the catalyst decreases below the pre-set threshhold, such reduction causes the magnet 65 to begin to descend within the catalyst flow tube 57 through force of gravity. When the descent of the magnet 65 causes the surface 69 thereof to be sufficiently spaced from the magnetic switch 51, the normally closed magnetic switch will no longer be affected by the magnet 65 and will close. Provided air is flowing through the conduit 11 with a sufficient pressure to cause closure of the air flow switch 17, under such circumstances, the circuit is closed, the solenoid 45 is activated causing the gate valve 41 to open allowing flow of air through the conduits 42 and 44 and thence to the pneumatic whistle 73 that will sound with a loud and piercing tone thereby notifying the operator of the spray equipment that insufficient catalyst is being supplied to properly cure the polyester material. A horn can be substituted for whistle 73.

In the preferred embodiment of the present invention, the battery 34 is a 3–9 volt lithium battery allowing long life. The solenoid 40 is a 3–9 volt solenoid.

The magnetic switch 51 has a stainless steel wall to protect against highly corrosive catalyst, which wall has a thickness of approximately between 0.03–0.15 inches. The magnet 65 is preferably made of a rare earth material in a plastic housing that generates a powerful enough field to activate the magnetic switch across the stainless steel wall having the thickness above-described. The preferred magnet 65 is ALNICO 5, a carbon free, electrically conductive aluminum/nickel/cobalt alloy encased in a polyethylene housing.

In the preferred embodiment, when the magnet 65 moves between about 0.05 to 0.200 inches away from the housing of the magnetic switch 51, this is a sufficient distance of separation to cause the magnetic switch 51 to close.

The system as designed is advantageous because battery power is only used to activate the solenoid valve 40 when it is desired to activate the pneumatic whistle 73. Thus, battery life is significantly increased.

In the preferred mode of operation of plural component spray equipment, the delivery rate of the catalyst may be in the range of 5 cubic centimeters per minute to 150 cubic centimeters per minute. Thus, for example, the configuration of the catalyst flow tube 57 and the magnet 65 are chosen to cause the magnet 65 to descend within the flow tube 57 when the delivery rate reduces below 5 cubic centimeters per minute.

As such, an invention has been disclosed in terms of a preferred embodiment thereof that fulfills each and every one of the objects of the invention as set forth hereinabove and provides a new and useful catalyst flow alarm of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. A catalyst flow alarm, comprising:

a) an air conduit having an inlet and an outlet and an air flow switch in said conduit closed by air flow above a pre-set rate, said outlet being fluidly connected to a pneumatic indicator via a normally closed valve;

b) a catalyst flow tube comprising a chamber having an inlet and an outlet, said chamber inlet opening downwardly and said chamber outlet opening in a wall adjacent said chamber inlet;

c) a normally open magnetically actuable switch mounted outside an opposite chamber wall;

d) a permanent magnet contained within said chamber and biased toward said chamber inlet by force of gravity;

e) said air flow switch and magnetically actuable switch being included in an electrical circuit including an actuator for said valve, whereby, when said air flow switch is closed responsive to air flowing through said conduit and catalyst is flowing through said chamber at sufficient flow rate to cause said magnet to rise to a location adjacent said opposite chamber wall, said magnetically actuable switch remains open and said valve remains closed, and, whereby, when said catalyst flow rate drops below a pre-set threshold, said magnet drops away from said opposite chamber wall and said magnetically actuable switch closes, thereby closing said circuit and causing said valve actuator to open said valve and allow air to be supplied to said pneumatic indicator to indicate flow of catalyst below said pre-set threshold.

2. The alarm of claim 1, wherein said valve actuator comprises a solenoid.

3. The alarm of claim 2, wherein said valve comprises a gate valve.

4. The alarm of claim 2, wherein said pneumatic indicator comprises a horn.

5. The alarm of claim 1, wherein said magnetically actuable switch has a housing, a portion of which comprises the wall opposite the chamber inlet.

6. The alarm of claim 5, wherein the wall is made of a chemically resistant material.

7. The alarm of claim 1, wherein said magnet is protected from the catalyst by a plastic coating.

8. The alarm of claim 1, wherein said circuit includes a battery.

9. The alarm of claim 7, wherein the plastic coating is polyethylene.

10. A catalyst flow alarm, comprising:

a) an air conduit having an inlet and an outlet and an air flow switch in said conduit closed by air flow above a pre-set rate, said outlet being fluidly connected to a pneumatic horn via a normally closed gate valve;

b) a catalyst flow tube comprising a chamber having an inlet and an outlet, said chamber inlet opening downwardly and said chamber outlet in a wall adjacent said chamber inlet;

c) a normally open magnetically actuable switch mounted outside an opposite chamber wall;

d) a permanent magnet contained within said chamber and biased toward said chamber inlet by force of gravity;

e) said air flow switch and magnetically actuable switch being included in an electrical circuit including a battery and a solenoid actuator for said valve, whereby, when said air flow switch is closed responsive to air flowing through said conduit and catalyst is flowing through said chamber at sufficient flow rate to cause said magnet to rise to a location adjacent said opposite chamber wall, said magnetically actuable switch remains open and said valve remains closed, and, whereby, when said catalyst flow rate drops below a pre-set threshold, said magnet drops away from said opposite chamber wall and said magnetically actuable switch closes, thereby closing said circuit and causing said solenoid valve actuator to open said valve and allow air to be supplied to said pneumatic horn to indicate flow of catalyst below said pre-set threshold.

11. The alarm of claim 10, wherein said magnetically actuable switch has a housing, a portion of which comprises the wall opposite the chamber inlet.

12. The alarm of claim 10, wherein the wall is made of a chemically resistant material.

13. The alarm of claim 10, wherein the permanent magnet is coated with polyethylene.

14. The alarm of claim 11, wherein the wall opposite the chamber inlet is stainless steel.

15. The alarm of claim 10, wherein the permanent magnet is a carbon free, electronically conductive aluminum/nickel/cobalt alloy coated with polyethene.

* * * * *